US007127850B1

(12) United States Patent
Fex, Jr.

(10) Patent No.: US 7,127,850 B1
(45) Date of Patent: Oct. 31, 2006

(54) INTERNAL BUILDING PRESSURE APPARATUS AND METHOD

(76) Inventor: J. Patrick Fex, Jr., 1521 Via DeLuna, Pensacola Beach, FL (US) 32561

( * ) Notice: Subject to any disclaimer, the term of this patent is extended or adjusted under 35 U.S.C. 154(b) by 68 days.

(21) Appl. No.: 10/663,230

(22) Filed: Sep. 16, 2003

(51) Int. Cl.
*E04H 9/00* (2006.01)

(52) U.S. Cl. ..... 52/1; 52/100

(58) Field of Classification Search ..... 52/1, 52/100; 165/281; 236/49.3; 700/276; 73/756
See application file for complete search history.

(56) References Cited

U.S. PATENT DOCUMENTS 3,521,546 A * 7/1970 Day ..... 454/313
3,602,427 A * 8/1971 Joesting ..... 236/82
4,502,842 A * 3/1985 Currier et al. ..... 417/8
4,606,228 A 8/1986 Whitmore
5,377,458 A * 1/1995 Dempster ..... 52/1
5,505,091 A * 4/1996 Ali ..... 73/714
5,540,555 A * 7/1996 Corso et al. ..... 417/44.2
5,645,866 A * 7/1997 Eckardt et al. ..... 425/130
5,956,903 A * 9/1999 Parker ..... 52/1
6,711,470 B1 * 3/2004 Hartenstein et al. ..... 700/276
6,726,111 B1 * 4/2004 Weimer et al. ..... 236/51
6,848,623 B1 * 2/2005 Weimer et al. ..... 236/11

* cited by examiner

*Primary Examiner*—Basil Katcheves

(57) ABSTRACT

An internal building pressure apparatus includes, in a building with walls and more than floor, at least one pressure sensor on at least more than one floor. A connection is provided for connecting pressure sensors and an analysis device is connected to the pressure sensors for receiving input from the pressure sensors and for providing sensor data output. According to another embodiment, a controller may be included either alone or in combination with the analysis device.

21 Claims, 4 Drawing Sheets

INTERNAL BUILDING PRESSURE APPARATUS AND METHOD

FIELD OF THE INVENTION

This invention relates to an internal building pressure apparatus and method. In particular, in a building with walls and more than one floor, an internal building pressure apparatus includes at least one pressure sensor per floor so as to provide data for analysis and control of interior building pressure.

BACKGROUND OF THE INVENTION

The regulation and manipulation of building pressures is a complicated and difficult issue. The regulation of building pressures is not only difficult to accomplish but it is exceedingly difficult to accomplish when guided by prior art assumptions. Assumptions concerning building pressure regulation have been determined by the Applicant to be, by and large, inaccurate if not totally misleading. Applicant's U.S. Pat. No. 6,584,855 discloses and discusses a unique apparatus and method for measuring building pressure by understanding the relation of exterior pressure forces and other variables on the "skin" of the building and also on the resulting internal building pressure. Nonetheless, a myriad of additional misconceptions concerning internal building pressure have yet to be addressed by the prior art One of the tasks of building maintenance personnel, building designers, building automatic control systems and building owners, is to properly control the internal temperature, humidity and air pressure of a building. Ideally, the internal air pressure of a building should be at equilibrium, and therefore, uniform between all of the floors, ceilings, walls, ceiling cavities, floor cavities and wall cavities, as well as all open areas, rooms and other interstitial areas of a building, so as to prevent the transmission of odors, gases, contaminants, or even humidity and temperatures, between the many floors of a multiple floor building. In other situations, internal building pressure control is critical for explosion and corrosion control and for protection during outdoor airborne biological, radiological, and chemical events and attacks.

A prevalent misconception exists that the only dynamic events that occur within the core of a building are temperature and/or elevator shaft related. The prior art has mistakenly thought that "chimney effect", "warm air rising", "buoyancy of air" or other scientific and not so scientific effects were the primary reasons that made buildings with more than one floor more difficult to temperature and humidity control. Others in the prior art have mistakenly thought that building elevator shafts caused pressure anomalies between the various floors of the building due to a "plunger" type of effect caused by the moving elevators.

While these explanations sound reasonable, Applicant has determined that they are incorrect. In fact, these explanations sound so reasonable and these effects seem so "uncontrollable", and the experts in the field considered these temperature and elevator related explanations so satisfactory, that the observed problems have simply been ignored and left unsolved for the past one hundred years.

Applicant has determined that elevators and elevator shafts do not combine to create an effective "plunger" effect and that warm air rising does not actually produce enough force to move much air easily between concrete floors, for example. Applicant has determined, instead, that the ever varying and dynamic pressure relationships between the various floors of a multiple floor building, generated by many variables over the height of the building, is the primary reason that buildings with more than one floor are difficult to temperature and humidity control. It is these pressure differences that can pull germs, for example only, from a third floor patient room and cause them to precipitate out on the tenth floor, thus uncontrollably spreading germs throughout a hospital.

A prevalent MISCONCEPTION that must be clarified with this patent, is that "warm air rising between" the various floors of a multiple floor building, is a problem. Even as of today, ASHRAE still says that this is one of the PRIMARY reason air moves from the lower floors of multiple floor buildings, to the upper floors. The extensive applications of "FIRE CODES" which began in the early 1970's, "sealed" the individual floors from each other, effectively turning them into "INDIVIDUAL PRESSURE VESSELS". The SLIGHT "pushing" pressure generated by the "buoyancy factors" of "warm air rising" is INSUFFICIENT to move air through the remaining holes, or even closed elevator doors.

The true cause of air moving from the lower floors of buildings towards the upper floors, is a DIRECT RESULT of dramatically higher speed winds impinging on the walls of the upper floors. EVERY DAY, OF EVERY YEAR. Plus, the wind continues to accelerate over the height of the building, increasing their effect. This increased wind velocity actually "sucks/pulls/exfiltrates", MUCH LARGER amounts of air from the upper floors, than ANYONE thought.

In 1648 Blaise Pascal wrote the primary rule of pressure "any change in pressure applied at any given point on a confined and incompressible fluid is transmitted undiminished throughout the fluid". The "air" within a standard multiple story building is our "fluid" and can be considered "confined" by the building's walls. The influences inside of a standard multiple floor building, even the TALLEST one in the World, are incapable of "compressing" the existing air column to any significant amount, due to the aforementioned FIRE CODES. ASHRAE suggest the opposite with it's use of "stack pressures".

I ask the simple question, how can a multiple floor buildings with "sealed" FIRE floors, generate a "stack pressure"? Air in a multiple floor building can be considered "incompressed". Air is "compressed" by the fans of the air handling equipment, which can add heat, but this same air as it exist on the various floors, is "incompressed". So, as this SIGNIFICANT "negative" pressure influence is generated and "applied" to these upper floors, it is "transmitted throughout the" air of the ENTIRE BUILDING, regardless of the number of floors involved, or the applied FIRE CODES.

As this "negative" pressure influence generated on the upper floors of multiple floor buildings, seeks to reach equilibrium within the confines of the building "vessel", it "sucks/pulls/draws" from the lower floors. The "negative" pressure generated, IS sufficient to affect ALL of the individual floors of the building, regardless of the applied FIRE CODES. As more and more air is "sucked/pulled/exfiltrated" from the upper floors, over height, the increasing "negative" pressures generated, in turn "sucks/pulls/draws" even more and more air from the lower floors. Another rule of pressure is "air will move from areas of higher pressure, towards areas of lower pressure". These lower floors simply represent, the "source of least resistance" for air, to replace the air "LOST" from the upper floors.

It takes the DRAMATIC and DEEP "negative" pressures generated EXACTY as described, to "suck/pull/draw" air through even the smallest remaining cracks, between the floors and through wall cavities, floor cavities, ceiling cavities and ANY other interstitial space of a multiple floor building. NEITHER "warm air rising", NOR "stack effect", could EVER produce the building pressure problems that the Applicant has encountered. To COMPLETELY SOLVE a problem, one MUST FIRST COMPLETELY understand the problem. Up until that MOMENT, one is ONLY "treating" the SYMPTOMS of the PROBLEM. Which is EXACTLY what ASHRAE and ALL BEFORE ME are doing. TREATING SYMPTOMS. I offer the COMPLETE CURE for ALL of the "BUILDING PRESSURE" problems they are encountering. Applicant is the first to FULLY UNDERSTAND this "dynamic" situation, that occurs within EVERY multiple floor building. Thus, there is a need in the art for providing an apparatus and method which provides dynamic, responsive control of internal building pressure in buildings with more than one floor. It, therefore, is an object of this invention to provide an internal building pressure apparatus and method for obtaining the pressure relationships between the floors of a building with more than one floor and thereafter regulating the pressures as circumstances and individual needs require. Such apparatus and method must be able to account for any variable and arrive at an accurate pressure relationship for the individual floors of a building.

SUMMARY OF THE INVENTION

An internal building pressure apparatus and method of the present invention includes, in a building with walls and more than one floor, at least one pressure sensor per floor. A connection is provided for connecting the pressure sensors and an analysis device is connected to the pressure sensors for receiving input from the pressure sensors and for providing sensor data output.

According to another embodiment of the invention, a controller is connected to the analysis device wherein the controller regulates internal pressure on at least two or more of the floors and possibly all of the floors of a building. According to a further embodiment, the building includes multiple floors and the analysis device provides sensor data output from a group of outputs including sensor data output from adjacent floors and sensor data output from non-adjacent floors. According to a further aspect of the invention, the sensor data output includes output from a group including maximum pressure, minimum pressure, average pressure and any pressure in between maximum and minimum for a particular floor and the building as a whole. According to another aspect of the invention, at least one pressure sensor outside of the building is provided and the sensor data output includes output from a group including total internal building pressure and outside pressure, and/or the internal pressure of a particular floor and outside pressure or a portion of a particular floor and outside pressure.

According to further aspects of the invention, sensor data output includes output from a group including within wall pressure only and between floor pressure only. A further aspect of the invention includes a plurality of pressure sensors per floor. Another aspect of the invention includes pressure sensors placed in locations selected from a group of locations including open rooms, closed rooms, foyers, corridors, wall cavities, floor cavities, ceiling cavities, on walls, on ceilings, and on floors and any other interstitial area of the building.

According to another embodiment of the invention, in a building with walls and multiple floors, an internal building pressure apparatus includes at least one pressure sensor on at least more than one of the multiple floors. A connector connects the pressure sensors and an analyzer is connected to the pressure sensors for receiving input from the pressure sensors and for providing pressure sensor data output. According to another aspect of the invention, a controller is connected to the analyzer for controlling the pressure in the building in response to sensor data output from the analyzer. Other aspects of this invention are more fully disclosed hereafter.

According to a further embodiment of the invention, in a building with walls and multiple floors, a method of controlling internal building pressure includes the steps of providing at least one pressure sensor on at least more than one of the multiple floors. The pressure sensors are connected and an analyzer is attached to the pressure sensors for receiving input from the sensors and for providing sensor data output. According to a further aspect of the invention, a controller is attached to the analyzer and controls the pressure in the building in response to sensor data output from the analyzer. Other aspects of the method of invention according to further aspects of the invention are more fully disclosed hereafter.

DETAILED DESCRIPTION OF THE INVENTION

Figure 1:
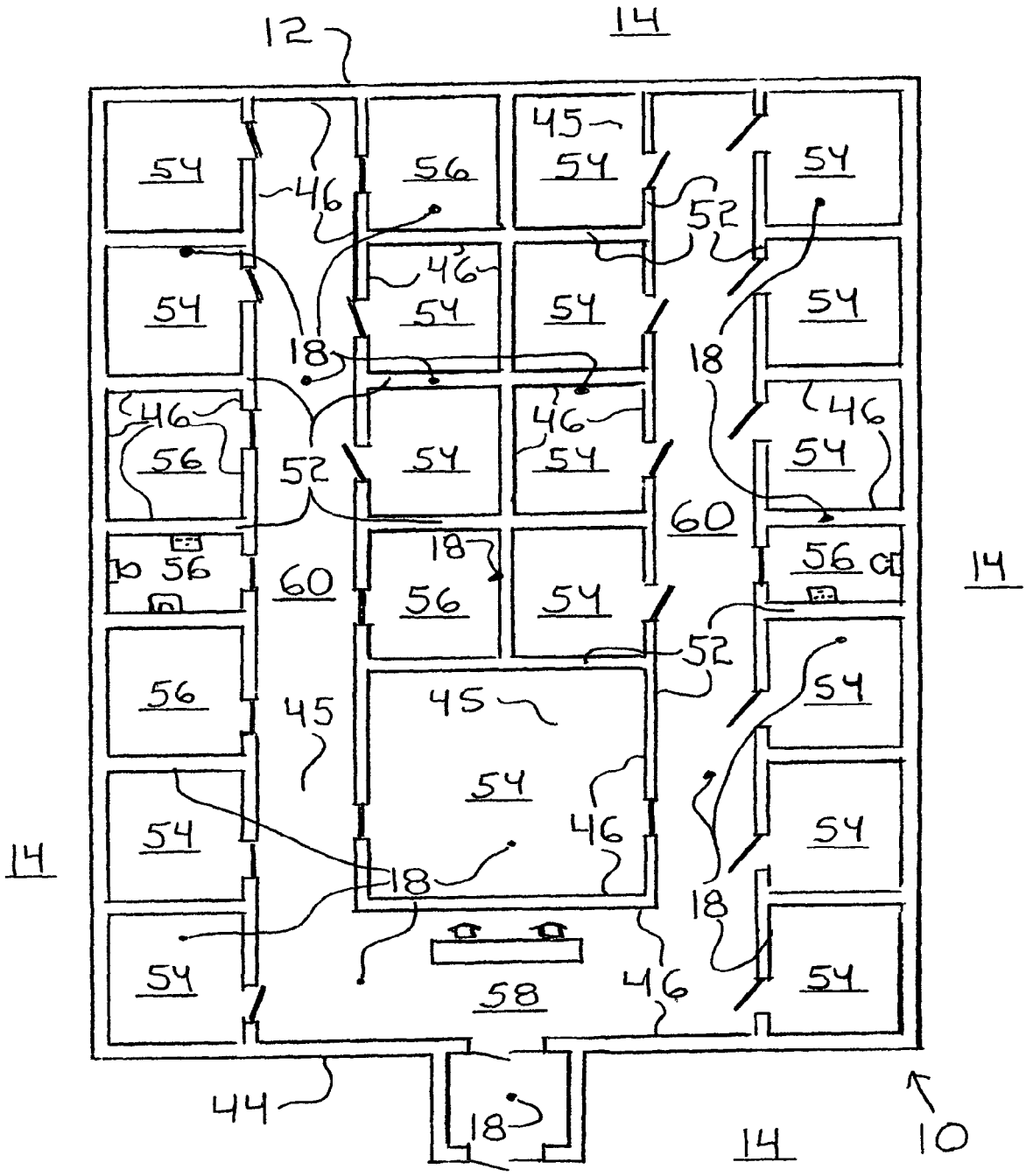
FIG. 1 is a top view of the present invention according to one embodiment illustrating the placement of pressure sensors about a generally symmetrical floor.

An embodiment of the present invention is illustrated by way of example in FIGS. 1–5. With specific reference to FIGS. 1–3, the internal building pressure apparatus 10 according to one embodiment of the present invention includes, in a building 12 with floors 44 and walls 46, at least one pressure sensor 18 on more than one of the multiple floors. This is to say that pressure sensors 18 may be on every floor 44 of a multiple floor building 12 or every other floor 44 or any combination of floors 44 desired. The location of pressure sensors 18 on one particular floor 44 need not match the location or quantity of pressure sensors 18 on any other floor 44. Any pressure sensor 18 location that is desired or appropriate may be used. As used herein the term "floor" 44 includes any combination of floor surfaces 45, walls 46 and ceilings 42, forming a closed 56 or open 54 space within a building 12.

Figure 2:
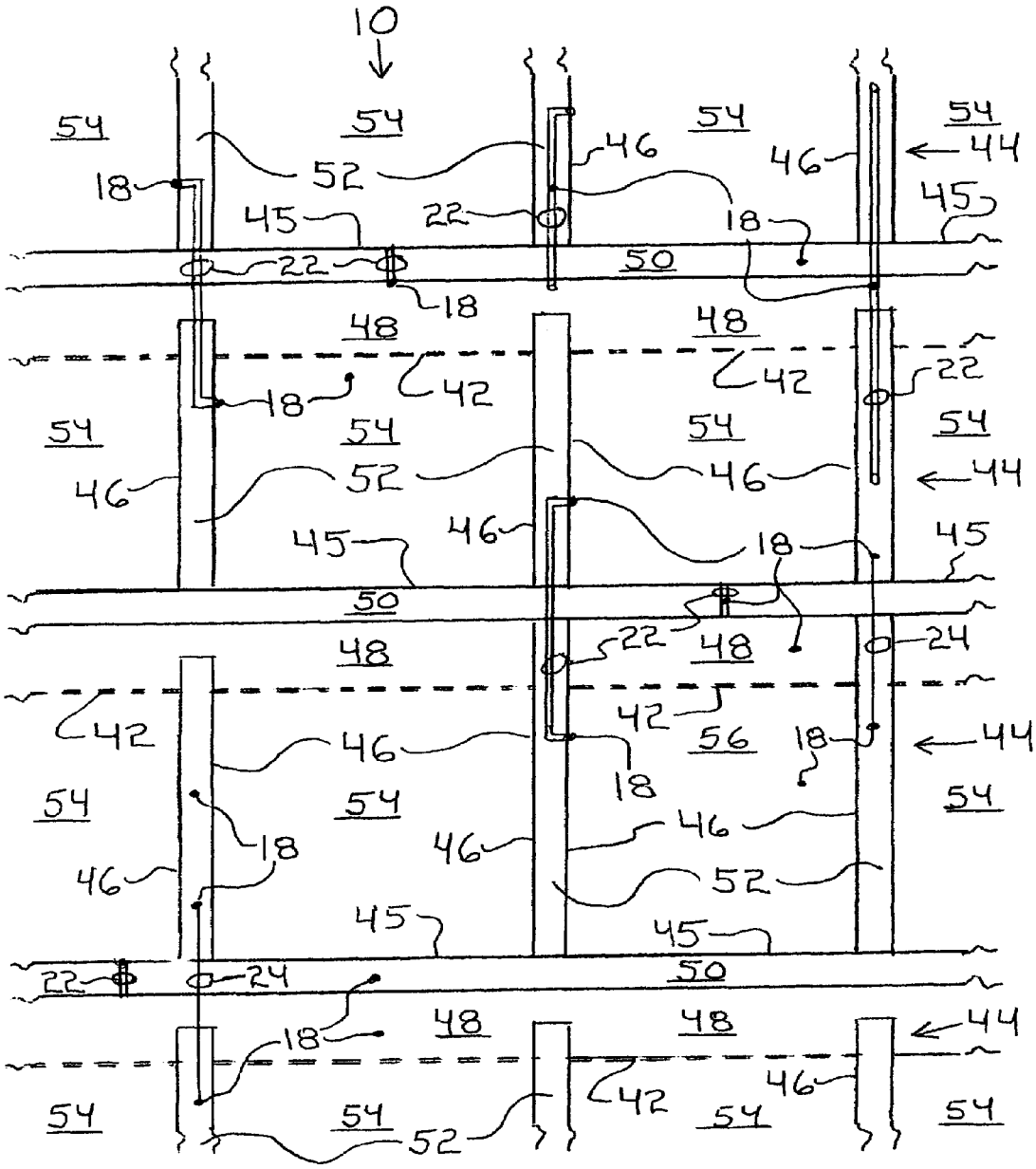
FIG. 2 is a plan view of the embodiment of FIG. 1 illustrating the placement of pressure sensors between adjacent floors.
Figure 3:
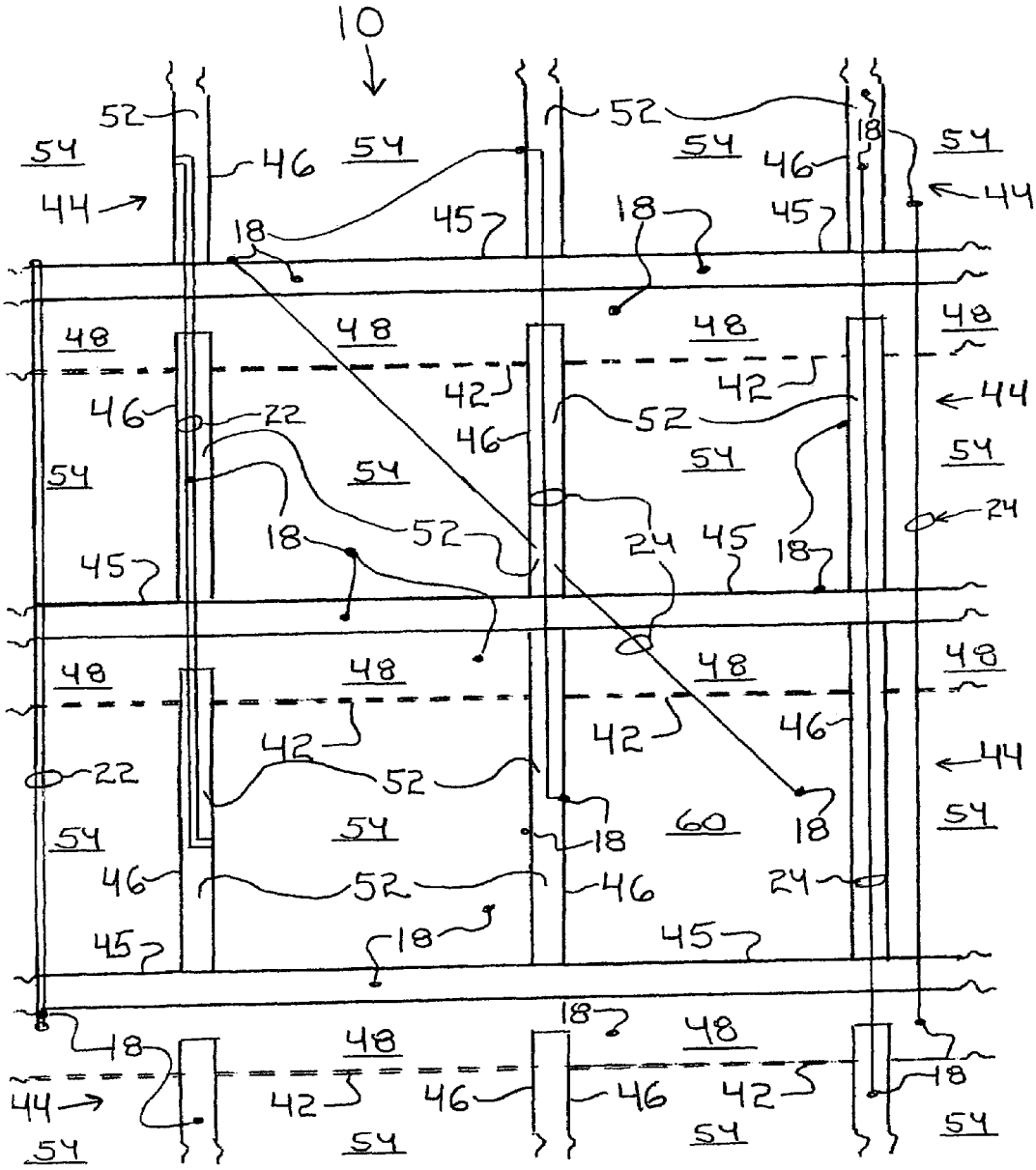
FIG. 3 is a plan view of the embodiment of FIG. 1 illustrating the placement of pressure sensors between non-adjacent floors.
Figure 4:
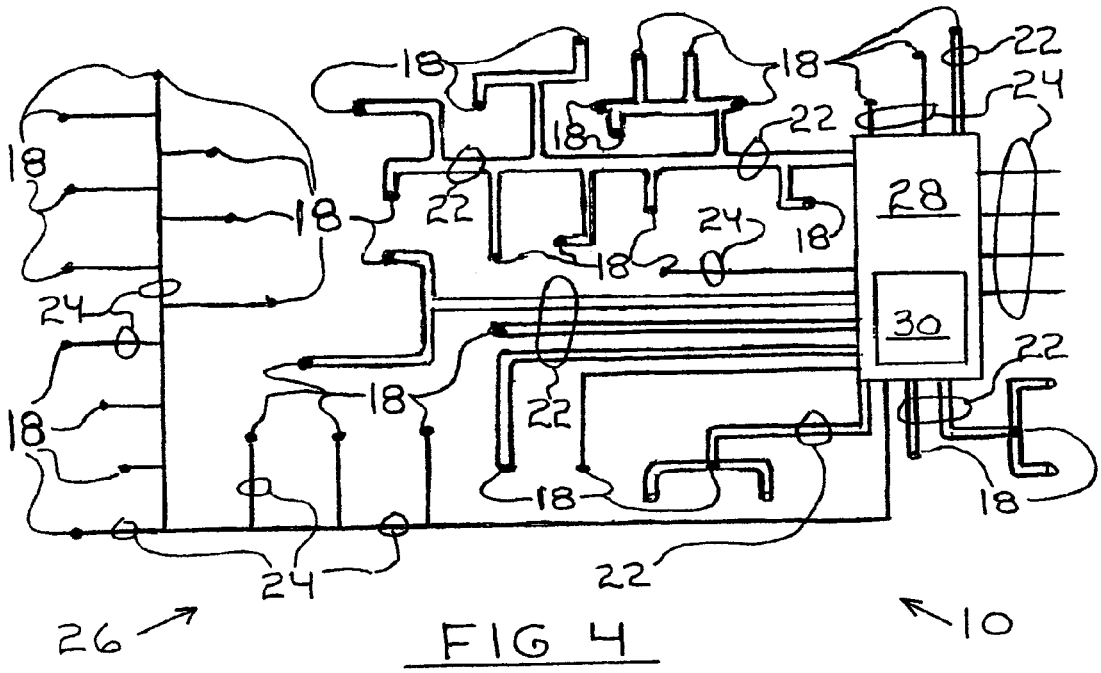
FIG. 4 is a schematic diagram of an analysis and connection system for analyzing and connecting separate pressure sensors of the embodiment of FIG. 1.
Figure 5:
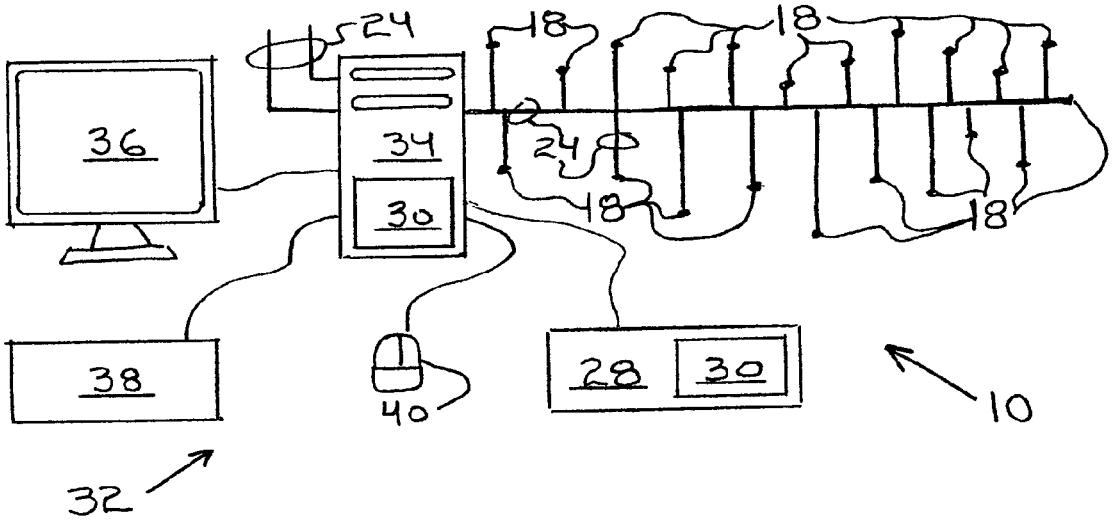
FIG. 5 is a schematic diagram of a control system for receiving and manipulating sensor data and controlling pressure within a building according to the embodiment of FIG. 1 of the invention.

For clarity, connection tubes 22 and connection wiring 24 that run back to an analyzer 26 and/or controller 32, as discussed more fully hereafter, have been purposefully left off of FIGS. 1–3. Refer to FIGS. 4 and 5 for additional details of connections 20, 22 and 24.

According to one embodiment, pressure sensor 18 is placed in a location selected from a group including within walls 46 and between floors 44. As will become more fully apparent hereafter, any pressure sensor 18 location that is desired or appropriate to the invention may be used. Within wall location, wall cavity, 52 may be any location within the wall 46 desired and/or appropriate. Between floor location, floor cavity, 50 likewise may be any between floor location 50 that is desired and/or appropriate. For example only, and not by way of limitation, any interstitial area of a building 12, such as a ceiling cavity 48, may also be a location for pressure sensor 18. Also, open rooms 54, closed rooms 56, foyers 58, corridors 60, and on walls 46, on floor surfaces 45 and ceilings 42 are examples of pressure sensor 18 locations.

Pressure sensors 18 are connected by connection 20, as will be disclosed more fully hereafter. Nonetheless, connection 20 may be any connection now known or hereafter created including connection tubing 22, connection wiring 24, or wireless connections, such as infrared, lasers and the like (not shown) as is well-known in the art and not disclosed more fully hereafter. According to the invention, connections 20 may be between each and every pressure sensor 18 or any selected group of pressure sensors 18 as desired.

An analysis device 26 is connected to the pressure sensors 18 for receiving input from the pressure sensors 18 and for providing sensor data output as will be disclosed more fully hereafter. Analysis device 26 may be any device now known or hereafter developed for receiving pressure sensor data input from the pressure sensors 18 and for providing sensor data output in a form useful to the user. It should be understood that pressure sensor 18 may include as an integral part an analysis device 26 in the case where the pressure sensor 18 itself produces an electrical or electronic measurement and output.

FIG. 1 most clearly illustrates the location of pressure sensors 18 within wall cavity location 52 as seen from the top of building 12. As illustrated, in FIG. 2, building 12 includes multiple floors 44 and FIG. 1 is a top view of only a single floor 44. FIG. 2 most clearly illustrates floor cavity locations 50 for pressure sensors 18. Pressure sensors 18 may also be placed on the outside 14 of a building 12 as and if desired. Once pressure sensors 18 are added to this additional area, comparisons can be made between the interior/internal pressure of building 12 as determined by pressure sensors 18 within walls 46 and between floors 44 and the pressure on the outside 14 of building 12. Still further, pressure sensors 18 may also be placed on the interior of walls 46 and on the visible floor surfaces 45 and/or ceilings 42 for additional pressure comparison points.

Referring now to FIG. 3, connections 20 are shown such that pressure sensors 18 are connected so as to enable analysis device 26 and/or control system 32 to obtain pressure information from non-adjacent floors 44. FIG. 2 illustrates the ability of connections 20 and analysis device 26 to provide pressure comparisons from pressure sensors 18 located on adjacent floors 44. Certainly any combination of adjacent and non-adjacent floor sensor comparisons are provided in accordance with the invention disclosed herein.

By way of a more complete description, the combinations of connections 20 and pressure sensors 18 and the variety of possible locations for pressure sensors 18 within walls 46 and between floors 44, as well as other desirable locations, are many indeed. That is to say, as illustrated in FIGS. 1–3, the various connections enable analysis device 26 and/or computer control system 32 to provide sensor data output from a group of outputs including sensor data output from adjacent floors 44 and sensor data output from non-adjacent floors 44. Still further, sensor data output includes output from a group including maximum pressure, minimum pressure, average pressure and pressure in-between maximum and minimum, for a particular floor 44 and for the building 12 as a whole.

Still further, when at least one pressure sensor 18 is provided on the outside 14 of building 12, sensor data output includes output from a group including total internal building pressure and pressure on the outside 14 of a building 12 and/or the internal pressure of a particular floor 44 or portion of a particular floor 44 and pressure on the outside 14 of building 12. Still further, obviously, sensor data output includes output from a group including within wall cavity 52 pressure only and between floor cavity 50 pressure only.

Referring now to FIG. 4, the individual pressure sensors 18 are shown connected by connections 20, either connection tubing 22 and/or connection wiring 24, or, again, any wireless connection now known or hereafter developed, to analysis device 26. Additionally, pressure sensors 18 are shown connected by connections 20, of any type, to each other so as to enable analysis and manipulation of pressure sensor data from any and every pressure sensor 18 alone or in any combination.

Analysis device 26 includes hardware 28/software 30. Hardware 28/software 30 is any such hardware 28 or software 30 or combination thereof now known or hereafter developed for receiving pressure sensor 18 input from pressure sensors 18 and converting it to usable sensor output. Such output may be any now known or hereafter desired, including pressure gauges, analog and/or digital read outs, images and the like. Pressure sensors 18 may also capture and transmit for analysis any other relevant data such as temperature, humidity and the like.

Referring now to FIG. 5, according to one embodiment of the invention, a control system 32 is connected to analysis device 26 or directly to pressure sensor 18 via connection 24. Control system 32 may be any control system now known or hereafter developed such as, but not limited to, for example, a CPU 34 and associated well-known elements such as monitor 36, keyboard 38, and mouse 40. Any of the well-known substitutes for one or all of these particular items is included within the scope of the invention. Control system 32 utilizes hardware 28/software 30 for the assimilation and manipulation of sensor data output from analysis device 32. By way of example only and not by limitation, computer control system ("controller") 32 receives sensor data output from analysis device 26, or directly from pressure sensors 18 via connection 24, for example, and regulates the internal pressure of building 12 in accordance with the user's desires. The user may, for example only and not by limitation, desire that the building 12 internal pressure be positive on each and every floor 44 of building 12. By comparing the internal pressure data with pressure on the outside 14 of building 12, a positive internal pressure may be maintained. A positive internal pressure of building 12, for example, ensures that no external contaminants are allowed to infiltrate building 12.

In another example, the user may desire to maintain all of the individual floors 44 at the same pressure to each other, regardless of the pressure relationship to outdoors 14. In both of these examples, the user has the similar goal of maintaining internal equilibrium between all floors 44 and to restrict air movement between floors 44.

On the other hand, by way of example again only, a negative internal pressure within the building 12 or within a particular floor 44 of building 12 may be desired as well.

Still further, the user may desire to maintain one or more floors 44 at a different pressure (either higher or lower) in relationship to surrounding floors 44, so as to isolate these floors 44 from the other floors 44 so as to prevent air from escaping or entering the floors 44. In sum, control system 32 in combination with other well-known heating, cooling and air-conditioning devices controls and manipulates the internal pressure of building 12 in any manner desired by the user.

The method for measuring and maintaining the pressure relationships between the floors 44 of buildings 12 with more than one floor 44 of the present invention includes the steps as previously disclosed and discussed above. The method is relatively simple to implement and execute. The steps, according to one embodiment, include attaching at least one pressure sensor 18 on at least more than one floor 44 of a multiple floor building 12 at any desired location. Pressure sensors 18 are connected by connections 24 and/or 22 as discussed above such that more than one measurement can be taken between floors 44 to produce additional, or more accurate, or averaged, information. That is to say, the pressure measurements can be made between multiple floors 44, and at multiple locations on each floor 44 and within open rooms 54 and corridors 60 of the individual floors 44, as well as on the walls 46, floor surfaces 45 and ceilings 42 as discussed above. Also, as a user desires, pressure sensors 18 may be placed within any interstitial spaces, cavities, of building 12 including, but not limited to, wall cavity 52, floor cavity 50 and ceiling cavity 48 as well as on the outside 14 of the building 12. Obviously, the sensor 18 arrangement for one floor 44 and/or wall 46, need not match the pressure sensor 18 arrangement of the any other floor 44 or wall 46. Analysis device 26, whether in combination with control system 32 or not, allows the user to relate the pressure of any one floor 44 to that of another or to the building 12 as a whole in any number of useful schemes.

It should be understood that the term "sensor" as used herein applies to all known or newly discovered "pressure sensors". Certainly a wide variety of known pressure sensors 18 can be used to employ this present invention. Some pressure sensors 18, as now known, have the ability to produce an electrical/electronic, pressure measurement. This pressure measurement is the pressure sensor output as discussed herein which can be electrically/electronically relayed to analysis device 26 and/or control system 32 as desired. Other pressure sensors 18 may simply communicate a pressure via a tube/conduit to a device that can then produce a measurement, that can then be relayed to analysis device 26 and/or control system 32 as desired.

The description of the present embodiments of the invention has been presented for the purposes of the illustration, but is not intended to be exhaustive or to limit the invention to the form disclosed. Many modifications and variations will be apparent to those of ordinary skill in the art. As such, while the present invention has been disclosed in connection with the preferred embodiment thereof, it should be understood that there may be other embodiments which fall within the spirit in scope of the invention as defined by the following claims.

What is claimed is:

1. In a building with multiple walls and multiple floors and a heating, ventilating, air-conditioning (HVAC) system, an internal building pressure apparatus comprising:

a) at least one pressure sensor per floor on at least two of said multiple floors;

b) a connection means connecting the pressure sensors; and c) an analysis means connected to said pressure sensors and receiving input from said pressure sensors and comparing at least one pressure reading from one floor with another pressure reading from at least one other of the multiple floors of said building and for providing sensor data output, a controlling means attached to the analysis means and to the HVAC system and controlling the pressure on at least one of the multiple floors in response to sensor data output from said analysis means by controlling the operation of the HVAC system so as to attain a desired pressure on at least one of said multiple floors.

2. The apparatus of claim 1 wherein said building includes multiple floors and said analysis means provides sensor data output form a group of outputs including sensor data output from adjacent floors and sensor data output from non-adjacent floors.

3. The apparatus of claim 1 wherein said sensor data output includes output from a group including maximum pressure, minimum pressure, average pressure and pressure in-between maximum and minimum, for a particular floor, for a portion of a particular floor and the building as a whole.

4. The apparatus of claim 1 further comprising at least one pressure sensor outside of said building and wherein said sensor data output includes output from a group including total internal building pressure, internal pressure of a particular floor, internal pressure of a portion of a particular floor and outside pressure.

5. The apparatus of claim 1 wherein said sensor data output includes output from a group including within wall pressure only and floor to floor pressure only.

6. The apparatus of claim 1 wherein said at least one pressure sensor is placed in a location selected from a group including within a wall cavity, within a floor cavity, within a ceiling cavity, in a room, corridor, hall and foyer and any other interstitial space of said building.

7. The apparatus of claim 1 further comprising providing at least one dynamic pressure sensor to measure the direction and velocity of air as it flows between at least two adjacent floors of said multiple floors and element c) includes analyzing this dynamic pressure relationship.

8. The apparatus of claim 1 further comprising at least one dynamic pressure sensor between non-adjacent floors, of said multiple floors, utilizing tubes or the like between these non-adjacent floors to allow them to communicate their dynamic pressure difference.

9. The apparatus of claim 1 further comprising at least one dynamic skin pressure sensor and said sensor data output includes choosing the output form a group including total internal building pressure, internal pressure of a particular floor, internal pressure of a portion of a particular floor, dynamic building skin pressure, and floor to floor dynamic pressure, and element c) includes analyzing this dynamic pressure relationship.

10. The apparatus of claim 9 wherein a plurality of dynamic pressure sensors are utilized.

11. The apparatus of claim 1 utilizing a computer.

12. The apparatus of claim 1 utilizing computer readable data storage medium.

13. A method of controlling pressure in a building with multiple walls and multiple floors and a heating, ventilating, air-conditioning (HVAC) system, the method comprising the steps of:

a) providing at least one pressure sensor on at least two of said multiple floors;

b) connecting to the pressure sensors together;

c) attaching an analyzer to said pressure sensors for receiving input from said pressure sensors and comparing at least one pressure reading from one floor with another pressure reading from at least one other of the multiple floors of said building and for providing sensor data output, attaching a controller to the analyzer and the HVAC system and controlling the pressure on at least one of the multiple floors in response to sensor data output from said analyzer by controlling the operation of the HVAC system so as to attain a desired pressure on at least one of said multiple floors.

14. The method of claim 13 wherein said sensor data output includes output from a group including maximum pressure, minimum pressure, average pressure and pressure in-between maximum and minimum, for a particular floor, for a portion of a particular floor and the building as a whole.

15. The method of claim 13 further comprising the step of providing at least one pressure sensor outside of said building and wherein said sensor data output includes output from a group including total internal building pressure, internal pressure of a particular floor, internal pressure of a portion of a particular floor and outside pressure.

16. The method of claim 13 further comprising the step of placing pressure sensors at locations selected from a group including within a wall cavity, within a floor cavity, within a ceiling cavity, in a room, corridor, hall and foyer and any other interstitial space of said building.

17. The method of claim 13 further comprising the steps of providing at least one dynamic pressure sensor to measure the direction and velocity of air as it flows between at least two adjacent floors of said multiple floors and analyzing this dynamic pressure relationship.

18. The method of claim 13 further comprising the steps of providing at least one dynamic pressure sensor between non-adjacent floors, of said multiple floors, utilizing tubes between non-adjacent floors to allow them to communicate their dynamic pressure difference analyzing this dynamic pressure relationship.

19. The method of claim 13 further comprising the steps of providing at least one dynamic skin pressure sensor and said sensor data output includes choosing the output form a group including total internal building pressure, internal pressure of a particular floor, internal pressure of a portion of a particular floor, dynamic building skin pressure, and floor to floor dynamic pressure, and analyzing this dynamic pressure relationship.

20. The method of claim 13 utilizing a computer.

21. The method of claim 13 utilizing computer readable data storage medium to store.

* * * * *